US011168698B2

(12) United States Patent
Botkin et al.

(10) Patent No.: US 11,168,698 B2
(45) Date of Patent: Nov. 9, 2021

(54) CEILING FAN

(71) Applicant: Hunter Fan Company, Memphis, TN (US)

(72) Inventors: Charles William Botkin, Cordova, TN (US); Bobby Neal Norwood, Oakland, TN (US); Matthew McPherson, Memphis, TN (US); James Thomas Breeden, Jr., Toone, TN (US)

(73) Assignee: Hunter Fan Company, Memphis, TN (US)

( * ) Notice: Subject to any disclaimer, the term of this patent is extended or adjusted under 35 U.S.C. 154(b) by 133 days.

(21) Appl. No.: 16/550,814

(22) Filed: Aug. 26, 2019

(65) Prior Publication Data

US 2020/0063746 A1 Feb. 27, 2020

Related U.S. Application Data

(60) Provisional application No. 62/723,238, filed on Aug. 27, 2018.

(51) Int. Cl.

| | |
|---|---|
| ***F04D 29/34*** | (2006.01) |
| ***F04D 25/08*** | (2006.01) |
| ***F04D 29/38*** | (2006.01) |

(52) U.S. Cl.

CPC ..... *F04D 25/088* (2013.01); *F04D 29/34* (2013.01); *F04D 29/384* (2013.01)

(58) Field of Classification Search

None

See application file for complete search history.

(56) References Cited

U.S. PATENT DOCUMENTS

| | | | | |
|---|---|---|---|---|
| D265,502 | S | 7/1982 | Kearns | |
| 4,396,352 | A * | 8/1983 | Pearce | F04D 29/36 416/206 |
| 4,750,863 | A * | 6/1988 | Scoggins | F04D 29/703 416/146 R |
| 5,668,920 | A * | 9/1997 | Pelonis | F04D 25/088 392/361 |
| 5,873,701 | A * | 2/1999 | Shiu | F04D 29/36 416/205 |
| 6,250,886 | B1 | 6/2001 | Immell et al. | |
| D516,696 | S | 3/2006 | Chen | |
| D517,194 | S | 3/2006 | Gerhardt et al. | |
| D599,900 | S | 9/2009 | Chen | |

(Continued)

FOREIGN PATENT DOCUMENTS

CN 304495053 S 2/2018

OTHER PUBLICATIONS https://www.minkagroup.net/f831l-whf.html, Minka Tear 60" 3-Blade LED Ceiling Fan, Model No. F831L-WHF, accessed Mar. 7, 2018.

(Continued)

*Primary Examiner* — Michael Lebentritt

(74) *Attorney, Agent, or Firm* — McGarry Bair PC

(57) ABSTRACT

A ceiling fan can include a motor having a rotor defining a rotational axis and a rotor periphery. At least one blade iron is mounted to the rotor and includes a first blade mount located radially exterior of the rotor periphery and a second blade mount located radially interior of the rotor periphery. A blade mounts to the blade iron at both the first blade mount and the second blade mount.

23 Claims, 12 Drawing Sheets

(56) References Cited

U.S. PATENT DOCUMENTS

| | | | | |
|---|---|---|---|---|
| D614,757 | S | 4/2010 | Noble | |
| D660,953 | S | 5/2012 | Allen et al. | |
| D675,720 | S | 2/2013 | Conillas | |
| D715,421 | S | 10/2014 | Schulzman | |
| D762,296 | S | 7/2016 | Badarello et al. | |
| D770,027 | S | 10/2016 | Noble et al. | |
| D773,030 | S | 11/2016 | Puerto | |
| D788,283 | S | 5/2017 | Busta | |
| D794,768 | S | 8/2017 | Wang | |
| D798,433 | S | 9/2017 | Badarello et al. | |
| D807,492 | S | 1/2018 | Hidalgo | |
| 9,982,679 | B2 * | 5/2018 | Santolucito | F04D 25/06 |
| D893,701 | S * | 8/2020 | McRoberts | D23/411 |
| 2003/0202881 | A1 * | 10/2003 | MacCuaig | F04D 29/34 416/62 |
| 2004/0009064 | A1 * | 1/2004 | Young | F04D 25/088 416/5 |
| 2006/0140770 | A1 * | 6/2006 | Liu | F04D 29/34 416/210 R |
| 2006/0278766 | A1 * | 12/2006 | Wang | F04D 25/088 248/74.1 |
| 2007/0104583 | A1 * | 5/2007 | Gajewski | F04D 29/384 416/210 R |
| 2009/0246028 | A1 * | 10/2009 | Richardson | F04D 29/34 416/210 R |
| 2010/0104442 | A1 * | 4/2010 | Haynes | F04D 25/088 416/210 R |
| 2011/0116946 | A1 * | 5/2011 | Webb | F04D 29/34 417/410.1 |
| 2011/0165002 | A1 * | 7/2011 | Noble | F04D 19/002 417/423.7 |
| 2012/0014796 | A1 * | 1/2012 | Cartwright | F04D 29/388 416/142 |
| 2012/0034085 | A1 * | 2/2012 | Lagman | F04D 25/088 416/210 R |
| 2013/0189104 | A1 * | 7/2013 | Hollan | F04D 29/34 416/135 |
| 2015/0211532 | A1 * | 7/2015 | Whitley | F04D 25/088 416/210 R |
| 2015/0337853 | A1 * | 11/2015 | Kang | H02K 1/16 416/244 R |
| 2016/0305441 | A1 * | 10/2016 | Armstrong | F04D 25/088 |
| 2017/0218962 | A1 * | 8/2017 | Yamamoto | F04D 29/325 |
| 2018/0102688 | A1 * | 4/2018 | Dhawan | H02K 9/19 |
| 2018/0128276 | A1 * | 5/2018 | Li | F04D 25/06 |
| 2019/0154060 | A1 * | 5/2019 | Santolucito | F04D 29/646 |
| 2019/0285084 | A1 * | 9/2019 | Yu | F04D 25/088 |
| 2020/0063759 | A1 * | 2/2020 | Ebersole | F04D 29/34 |
| 2020/0217327 | A1 * | 7/2020 | Noble | F04D 29/34 |
| 2020/0220426 | A1 * | 7/2020 | Horng | H02K 7/14 |
| 2020/0263700 | A1 * | 8/2020 | Lee | F04D 25/088 |
| 2020/0318648 | A1 * | 10/2020 | Wiegel | F04D 19/002 |

OTHER PUBLICATIONS http://www.kichler.com/products/product/60-inch-uma-ceiling-fan-aub-310085aub.aspx, Kichler Uma Collection, 60 Inch Uma Ceiling Fan AUB, Model No. 310085AUB (Auburn Stained Finish), accessed Mar. 7, 2018.

http://www.fanimation.com/products/index.php/fans/spitfire-495.html, Fanimation Spitfire Indoor/Outdoor 3-blade Ceiling Fan, Model No. MA6721, accessed Mar. 7, 2018.

https://www.craftmade.com/ceiling-fans/pireos/pireos-pir48esp3, Craftmade Pireos 48" Ceiling Fan with Blades, Model No. PIR48ESP3, accessed Mar. 7, 2018.

* cited by examiner

CEILING FAN

CROSS-REFERENCE TO RELATED APPLICATIONS

This Application claims the benefit of and priority to U.S. Provisional Patent Application No. 62/723,238, filed Aug. 27, 2018, the entirety of which is incorporated herein by reference.

BACKGROUND

Ceiling fans are utilized to move a volume of air about a space. Traditionally, the volume of air is moved via a set of blades on the ceiling fan, which are rotatably driven to push the volume of air. The ceiling fan can be connected to an electrical supply, which powers a motor to drive the blades. A set of blade irons can be used to mount the blades to the motor, or a rotor of the motor, to impart the rotational movement from the motor to the blades.

BRIEF SUMMARY

In one aspect, the disclosure relates to a ceiling fan including a motor having a rotor rotatable about a rotational axis and defining a rotor periphery; at least one blade iron mounted to the rotor and having a first blade mount located radially exteriorly of the rotor periphery and a second blade mount located radially interiorly of the rotor periphery; and a blade mounted to both the first and second blade mount and having a tip extending radially beyond the second blade mount.

In yet another aspect, the disclosure relates to a ceiling fan comprising a motor assembly including a stator and a rotor defining a rotor periphery and rotatable about the stator; a blade iron coupled to the rotor and including an arcuate body having a first end and a second end, with a first blade mount provided at the first end and a second blade mount spaced form the first blade mount and a provided at the second end, with the first blade mount and the second blade mount extending radially exterior of the rotor periphery; and a blade mounted to the blade iron at both the first blade mount and the second blade mount.

In yet another aspect, the disclosure relates to a ceiling fan comprising a motor assembly including a stator and a rotor rotatable about the stator; a blade iron hanger coupled to the rotor including an annular body and at least one arm extending from the annular body; and a blade iron including at least one opening adapted to receive the at least one arm of the blade iron hanger through the at least one opening to hang the blade iron form the blade iron hanger to facilitate alignment and mounting of the blade iron to the rotor.

DETAILED DESCRIPTION

Aspects of the present disclosure relate to a blade mounting assembly for a ceiling fan. For purposes of description related to the figures, the terms "upper," "lower," "top," "bottom," "right," "left," "rear," "front," "vertical," "horizontal," and derivatives thereof shall relate to the invention as oriented in FIG. 1 from the perspective of the ceiling fan hung with the blades extending in a manner parallel to a surface above which the ceiling fan hangs, such as a horizontal plane.

Figure 1:
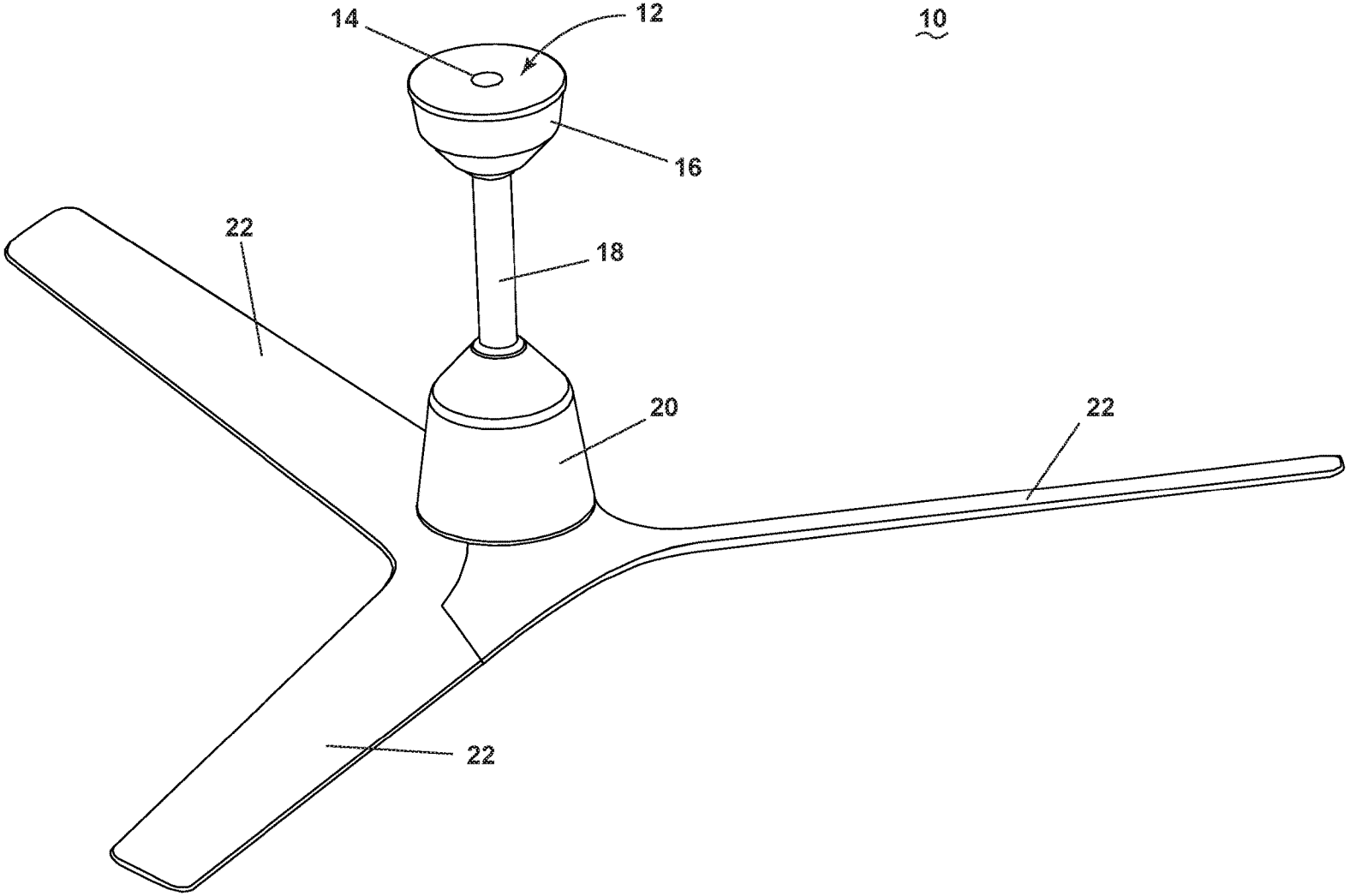
FIG. 1 is a top perspective view of a ceiling fan including a set of blades.

Referring now to FIG. 1, a ceiling fan 10 includes a hanger assembly 12 for suspending the remainder of the ceiling fan 10 from a building or a structure (not shown). The hanger assembly 12 can include a central aperture 14 to permit electrical wiring (not shown) to electrically couple to the ceiling fan 10. A canopy 16 covers the hanger assembly 12, providing for an aesthetically pleasing look for the ceiling fan at the suspension from the structure. A downrod 18 couples to and is suspended from the hanger assembly 12. In one example, a ball mount can couple to the downrod 18 and seat at the hanger assembly 12, for pivotably suspending the downrod 18 from the structure, while any suspension assembly is contemplated. The ceiling fan 10 further includes a motor housing 20 suspended from the downrod 18. One or more of the hanger assembly 12, the canopy 16, the downrod 18, or the motor housing 20, or other components associated therewith can be a ceiling mount, configured to mount a motor or stator of the motor to the ceiling.

A set of blades 22, shown as three blades 22, but can be any desired number, extends radially from the motor housing 20. While not required, the set of blades 22 and the motor housing 20 are shaped to provide a smooth transition between the two. The blades 22 can have an airfoil cross-sectional profile. The blades 22 can further include a slight taper, decreasing in chord as the blade extends radially outward from a root to a tip, while any plan-view shape is contemplated.

Figure 2:
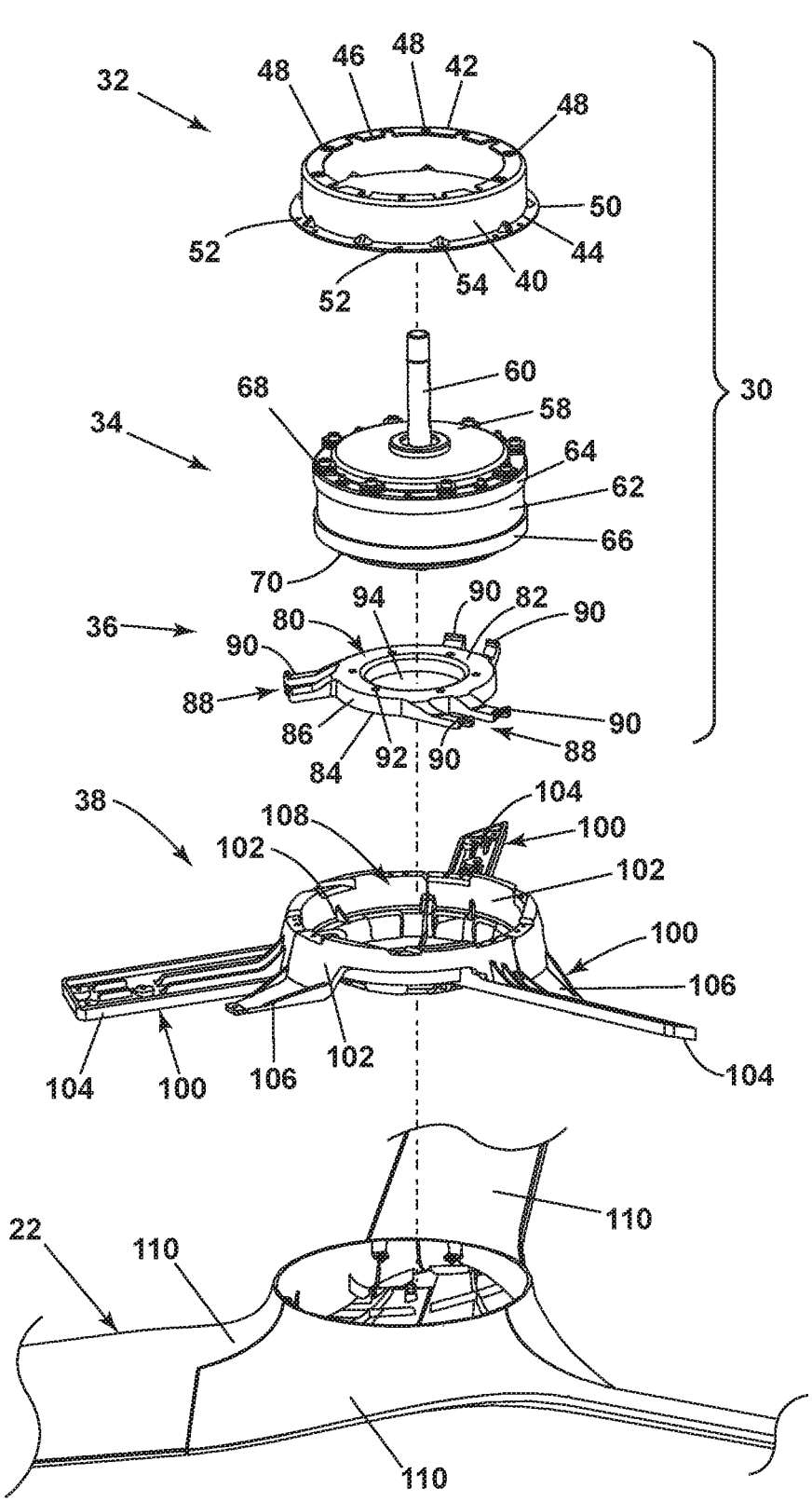
FIG. 2 is an exploded view of the ceiling fan of FIG. 1 showing a motor assembly, a set of blade irons, a set of blades, an iron hanger, and a mount ring.

Referring now to FIG. 2, an exploded view of the ceiling fan 10 is shown having the motor housing 20 of FIG. 1 removed, exposing a drive assembly 30 including a mount ring 32, a motor assembly 34, an iron hanger 36, and a set of blade irons 38 exploded from the set of blades 22. The mount ring 32 includes an annular peripheral wall 40 having a top edge 42 and a bottom edge 44. A rotor mount wall 46 extends radially inward from the peripheral wall 40 at the top edge 42 and includes a first set of fastener apertures 48. An iron mount wall 50 extends radially outwardly from the peripheral wall 40 at the bottom edge 44, and includes a second set of fastener apertures 52. A set of ribs 54 are provided radially about the mount ring 32 at the junction of the peripheral wall 40 and the iron mount wall 50, which can provide for improved structural integrity.

The motor assembly 34 can include a motor shaft 60, and can include a stator 58 and a rotor 62 circumscribing and external to the stator 58, and can be a permanent magnet motor, in one non-limiting example. The motor shaft 60 can be hollow to permit electrical wiring to extend to the stator to power the motor assembly 34. The stator 58 can be fixed to the motor shaft 60, with the rotor 62 rotatably driven about the stator 58 and motor shaft 60. The rotor 62 can be an external rotor 62, external to the stator 58. The rotor 62 can include a peripheral ring, which defines a rotational axis, which can be coincident with a longitudinal axis of the motor shaft 60. The rotor 62 can further define a rotor periphery, as the furthest radial extent of the rotor 62 relative to the motor shaft 60.

The rotor 62 can further include an upper rim 64 and a peripheral ring 66 or lower rim configured to rotate with the rotor 62. A first set of openings 68 can be provided in the upper rim 64 and a second set of openings 70 (best seen in FIG. 6) can be provided in the peripheral ring 66. The first set of openings 68 can be arranged complementary to the first set of fastener apertures 48 in the mount ring 32.

The iron hanger 36 can include an annular body 80 having an upper surface 82 and a lower surface 84, with a sidewall 86 extending between the upper surface 82 and the lower surface 84, and defining a central aperture 94 within the annular body 80. Three sets of arms 88 can extend radially outward from the annular body 80 at the sidewall 86, with each set of arms 88 including two arms 90. A set of fastener apertures 92 can be provided in the annular body 80, extending between the upper surface 82 and the lower surface 84.

The set of blade irons 38 can include three blade irons 100, which can couple to the peripheral ring 66 of the rotor 62 and collectively form a structure underlying the motor assembly 34. Each blade iron 100 can include an arcuate portion as a body 102, which collectively define an annular ring 108 for the body 102 when the set of blade irons 38 are arranged together, as shown. The body 102 can confront the peripheral ring 66 of the rotor 62. A first blade mount 104 and a second mount plate 106 extends from the body 102 of each blade iron 100. The first blade mount 104 and the second mount plate 106 can be positioned radially exterior of the rotor periphery. The first blade mount 104 can be spaced from the second mount plate 106 for each individual blade iron 100, such that the first blade mount 104 is positioned adjacent to another second mount plate 106 of a separate blade iron 100 of the set of blade irons 38, when arranged together, as shown.

The set of blades 22 can include three blades 110. The blades 110 can be shaped complementary to one another, such that arrangement of the blades together forms a continuous, substantially uniform set of blades 22.

Figure 3:
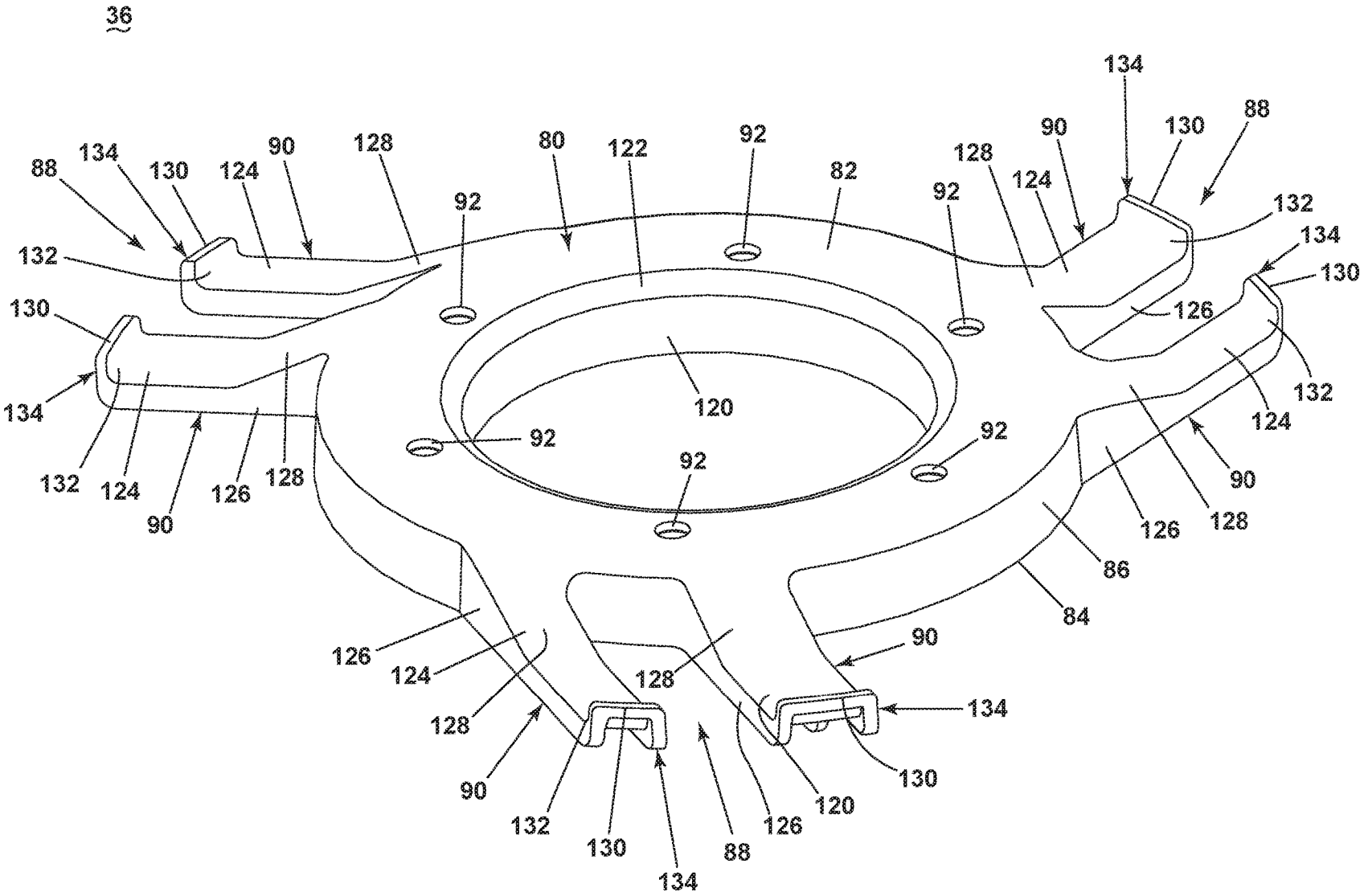
FIG. 3 is an enlarged view of the iron hanger of FIG. 2 having sets of arms.

Referring now to FIG. 3, the annular body 80 of the iron hanger 36 can include an interior wall 120. A tapered wall 122 can be transition between the upper surface 82 and the interior wall 120. Each arm 90 of the set of arms 88 can include a top surface 124 that is continuous with the upper surface 82 of the annular body 80, and opposing sides 126 that meet the sidewall 86 of the annular body 80. The top surface 124 can include a ramp 128 that extends downwardly from the upper surface 82 of the annular body 80, in a direction toward the lower surface 84 and radially outwardly from the annular body 80.

The arms 90 can be arranged in an offset manner, such that each arm 90 is offset from a radius of a circle defined by the annular body 80. Each arm 90 terminates at a tip 130. The tip includes a curved portion 132, which forms a hook 134 at the tip 130. The curved portion 132 extends above the local top surface 124 of the arm 90, to form the hook 134.

Figure 4:
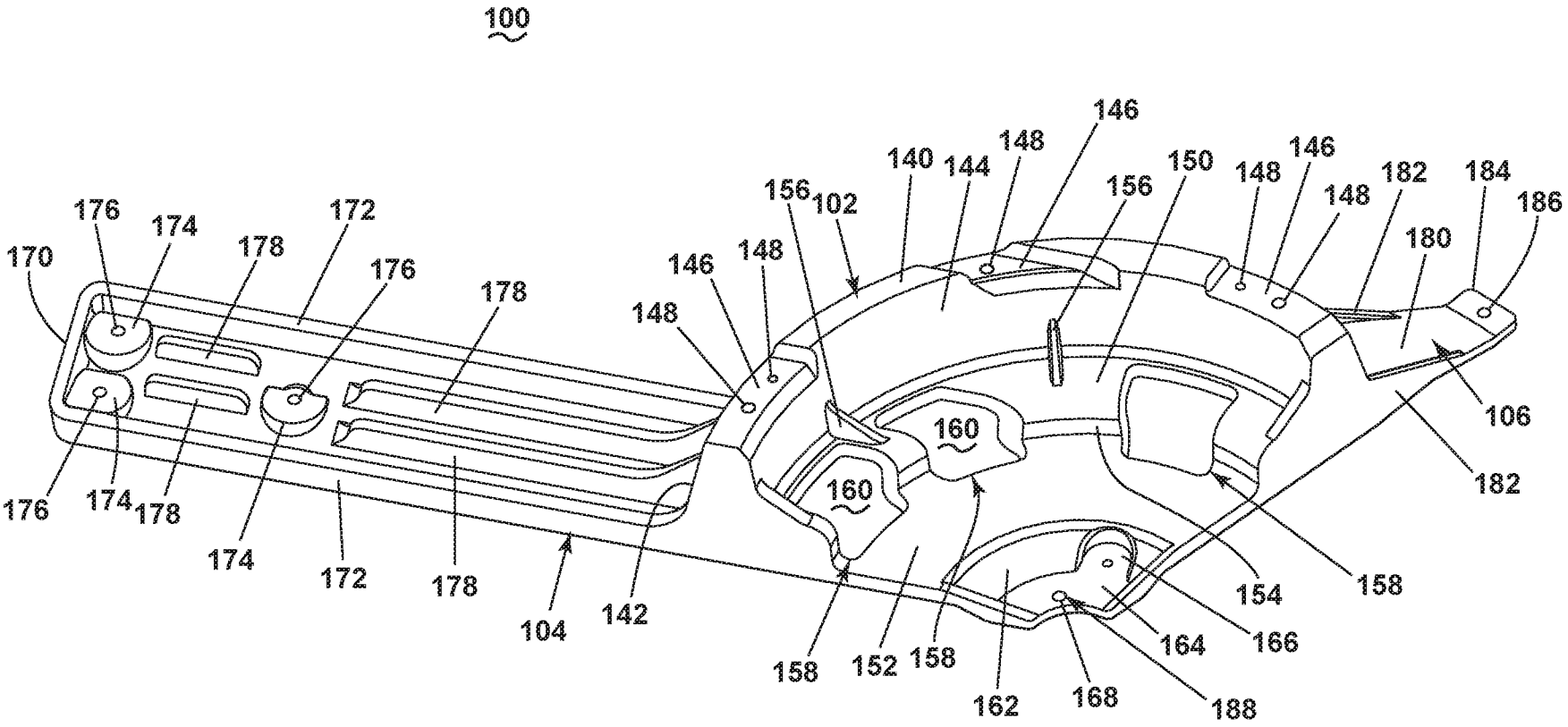
FIG. 4 is an enlarged view of one blade iron of the set of blade irons of FIG. 2 having a set of openings.

Referring now to FIG. 4, the body 102 of the blade iron 100 includes a top wall 140, an exterior wall 142, and an interior wall 144. A set of mount grooves 146 are formed in the top wall 140, and include a set of apertures 148 extending into the body 102 within the grooves 146 for mounting to the iron mount wall 50 of the mount ring 32 of FIG. 2. While shown as three grooves 146, any number of grooves is contemplated. The interior wall 144 extends to an intermediate wall 150, which extends radially inward from the interior wall 144. A center wall 152 extends radially inward from the intermediate wall 150 and joins to the intermediate wall 150 at a curved step 154. A set of support ribs 156 are provided at the junction of the interior wall 144 and the intermediate wall 150, which can improve the structural integrity of the blade iron 100. A set of openings 158 are formed within the blade iron 100, and extend among the intermediate wall 150 and the center wall 152. Two openings of the set of openings 158 can be arm openings 160, and can be sized to receive the set of arms 88 of the iron hanger 36 of FIG. 3. An interior ramp 162 can be formed in the center wall 152, extending to a bottom 164 of the center wall 152. A depression 166 can be formed in the interior ramp 162, and can have a substantially semi-circular shape. A center aperture 168 can be provided in the bottom 164. The bottom 164 and the center aperture 168 can collectively define a third blade mount 188, which can be positioned radially interior of the rotor periphery.

The first blade mount 104 can include a tip wall 170 and opposing sidewalls 172. The first blade mount 104 can have a substantially rectangular shape, having rounded corners at the junction between the tip wall 170 and the opposing sidewalls 172. A set of fastener ridges 174 can be formed in the first blade mount 104, shown as three fastener ridges 174, with each fastener ridge 174 including a fastener aperture 176. A set of support ribs 178 can also be provided in the first blade mount 104, between the fastener ridges 174, providing for increased structural integrity for the blade iron 100. The support ribs 178 nearest the body 102 can extend into and terminate at the exterior wall 142 of the body 102.

The second mount plate 106 can include an upper surface 180 and a pair of opposing sides 182. The upper surface 180 can be partially inset below the pair of opposing sides 182, such that opposing sides 182 extend above the upper surface 180. The second mount plate 106 can terminate at a tip 184, as a flat end of the second mount plate 106. A mount opening 186 can be provided at the tip 184.

Figure 5:
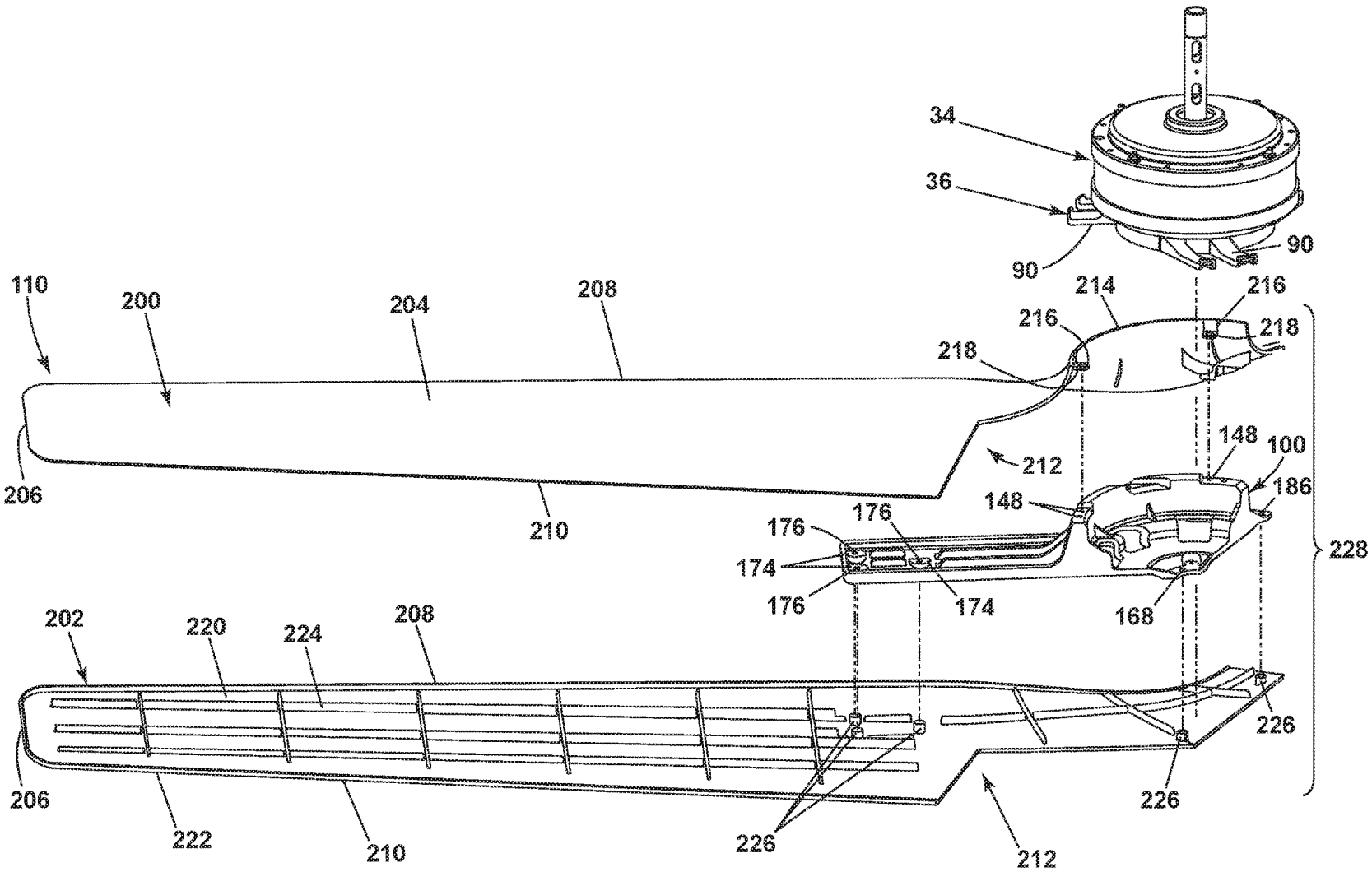
FIG. 5 is an exploded view of one blade and a blade iron, exploded from the assembled motor assembly and iron hanger of FIG. 2.

Referring now to FIG. 5, each blade 110 of the set of blades 22 can be two-part, having an upper portion 200 and a lower portion 202, while it is contemplated that the blade can be a single piece, such as a unitary, one-piece, or monolithic blade. Each portion 200, 202 can include a cutout portion 212. Each portion 200, 202 can include an upper surface 204, terminating at a tip 206 and extending between a leading edge 208 and a trailing edge 210, and defining a chord-wise direction between the leading edge 208 and the trailing edge 210.

The upper portion terminates at an arcuate interior edge 214. A set of fastener extensions 216 can extend from the interior edge 214 of the upper portion 200, opposite of the remainder of the blade 110, and can each include a fastener opening 218. While shown as two fastener extensions 216, any number of fastener extensions 216 is contemplated. The fastener extensions 216 can be arranged complementary to one or more apertures 148 on the top wall 140 of the blade iron 100.

The lower portion 202 can include a top surface 220 and a bottom surface 222. A set of internal ribs 224 are formed on the top surface 220. A similar set of internal ribs can be formed on the upper portion 200, obscured by the current top perspective view, while it is contemplated that that actual rib structure can vary from that shown. A set of receivers 226 can extend from the top surface 220 of the lower portion 202, shown as five receivers 226. The set of receivers 226 can be arranged complementary to the fastener apertures 176 in the fastener ridges 174, the center aperture 168, and the mount opening 186 of the blade iron 100.

Assembling the blades 110 includes sandwiching the blade iron 100 between upper portion 200 and the lower portion 202. In assembly, one or more fasteners (not shown), such as screws, bolts, pins, or the like, can be used to fasten the blade iron 100 to the lower portion 202. The fasteners can extend through the fastener aperture 176, the center aperture 168, and the mount opening 186 and secure within the receivers 226 on the lower portion 202 of the blade 110, securing the blade iron 100 to the lower portion 202. The upper portion 200 can be positioned on top of the lower portion 202, partially encasing the blade iron 100. The fastener extensions 216 can fasten the upper portion 200 to the blade iron 100 at the aperture 148 in the blade iron 100. Finally, the upper portion 200 can be fastened to the lower portion 202. In one non-limiting example, an adhesive can be used to secure the upper portion to the lower portion 202, such as glue or epoxy. Alternatively, it is contemplated that the upper portion 200 can be secured to the lower portion by other methods, such as welding, including ultrasonic welding, or mechanical fastening such as with a screw or bolt, in non-limiting examples, while any suitable method is contemplated. It is preferred that such an attachment method provides a uniform outer surface and appearance, such that there is no visible hardware on the exterior of the completed blade when assembled or installed.

The completed assembly includes the upper portion 200, the lower portion 202, and the blade iron 100 to form a blade assembly 228, which can mount to the motor assembly 34 for rotational movement of the blade assembly 228. The completed blade assembly 228 can have an airfoil cross-sectional profile, for example. Furthermore, in order to balance the blade assemblies 228 for mounting to the remainder of the ceiling fan 10, one or more weights can be fastened to the exposed portion of the blade iron 100 at the depression 166. For example, each completed blade assembly 228 of a set of blade assemblies 228 can be weighed, and the lighter two blade assemblies can have weights added at the depressions 166 to equalize the weights of the blade assemblies 228. Such balancing can provide for uniform rotation of the blades 110 during operation of the ceiling fan 10, which can improve operational efficiency or reduce wobble or vibration of the ceiling fan 10.

Coupling the blade 110 to the blade iron 100 at both the fastener apertures 176 of the first blade mount 104 and the mount opening 186 at the second mount plate 106 provides for a widened, more balanced mount for the blades 110. In this way, blade sag can be reduced, and can provide for improved blade balance, or even overall efficiency improvements during operation. The mounting at separate mount plates that are spaced from one another provides for a dual-mount system for coupling the blades to the blade irons. In this way, blade sage is reduced by utilizing a dual-mount system. Similarly, mounting at multiple locations along the blade iron provides for improved balance, which improves overall operational efficiency and can reduce noise.

Figure 6:
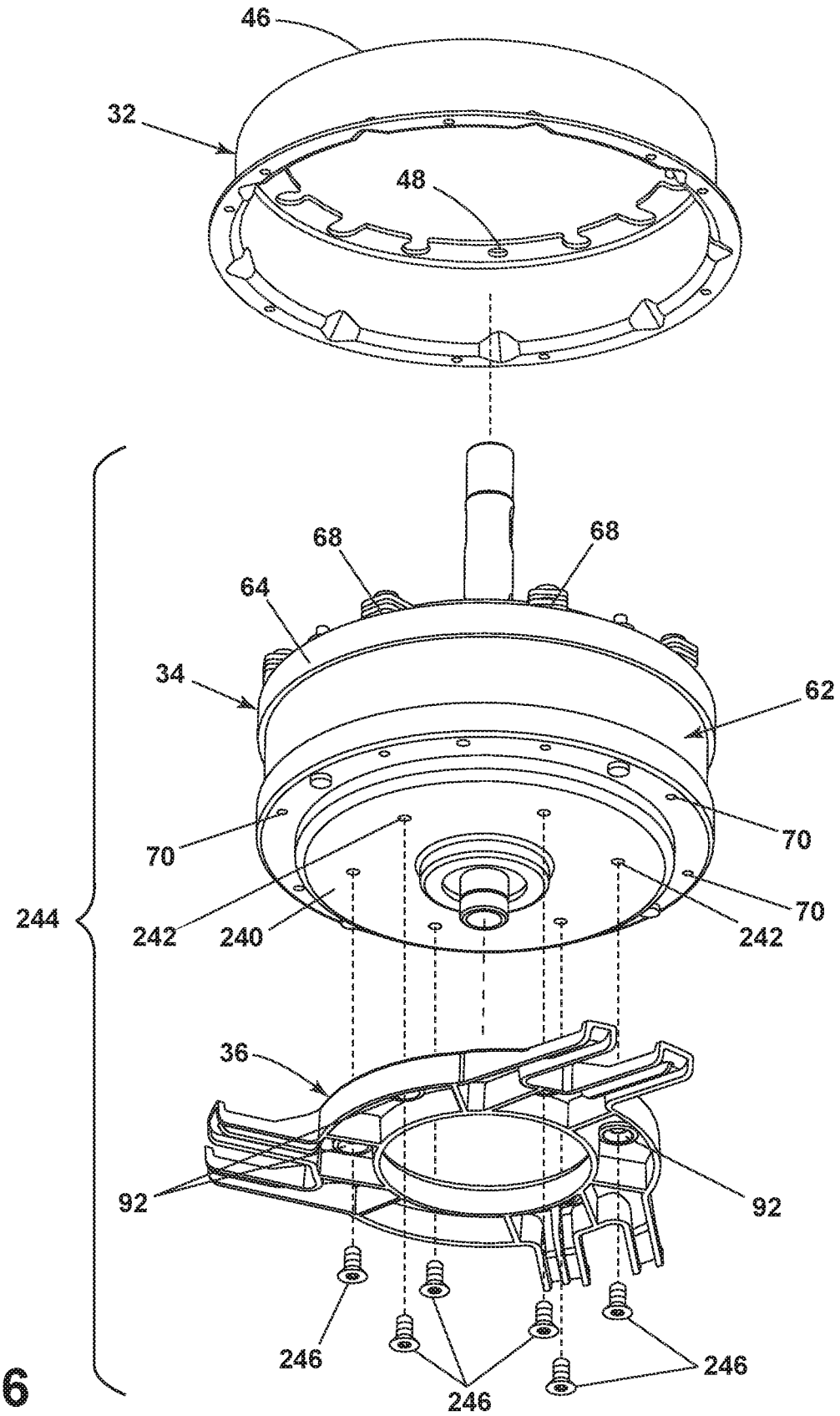
FIG. 6 is an exploded view of the mount ring, the motor assembly, and the iron hanger of FIG. 2, illustrating assembly thereof.

Referring now to FIG. 6, the mount ring 32 can couple to the motor assembly 34. The rotor mount wall 46 can secure to the upper rim 64 of the motor assembly 34, with a set of fasteners extending through the first set of fastener apertures 48 in the mount ring and the first set of openings 68 in the upper rim 64. Similarly, the iron hanger 36 can couple to the motor assembly 34. The motor assembly 34 can further include a bottom surface 240, which can be rotated as part of the rotor 62. A set of mount openings 242 are provided in the bottom surface 240. The iron hanger 36 can mount to the motor assembly 34 with a set of fasteners 246 extending through the set of fastener apertures 92 in the iron hanger 36 and securing in the complementary set of mount openings 242 in the bottom surface 240 of the motor assembly 34. In the assembled form, the coupled mount ring 32, motor assembly 34, and the iron hanger 36 can form a motor mount assembly 244

Figure 7:
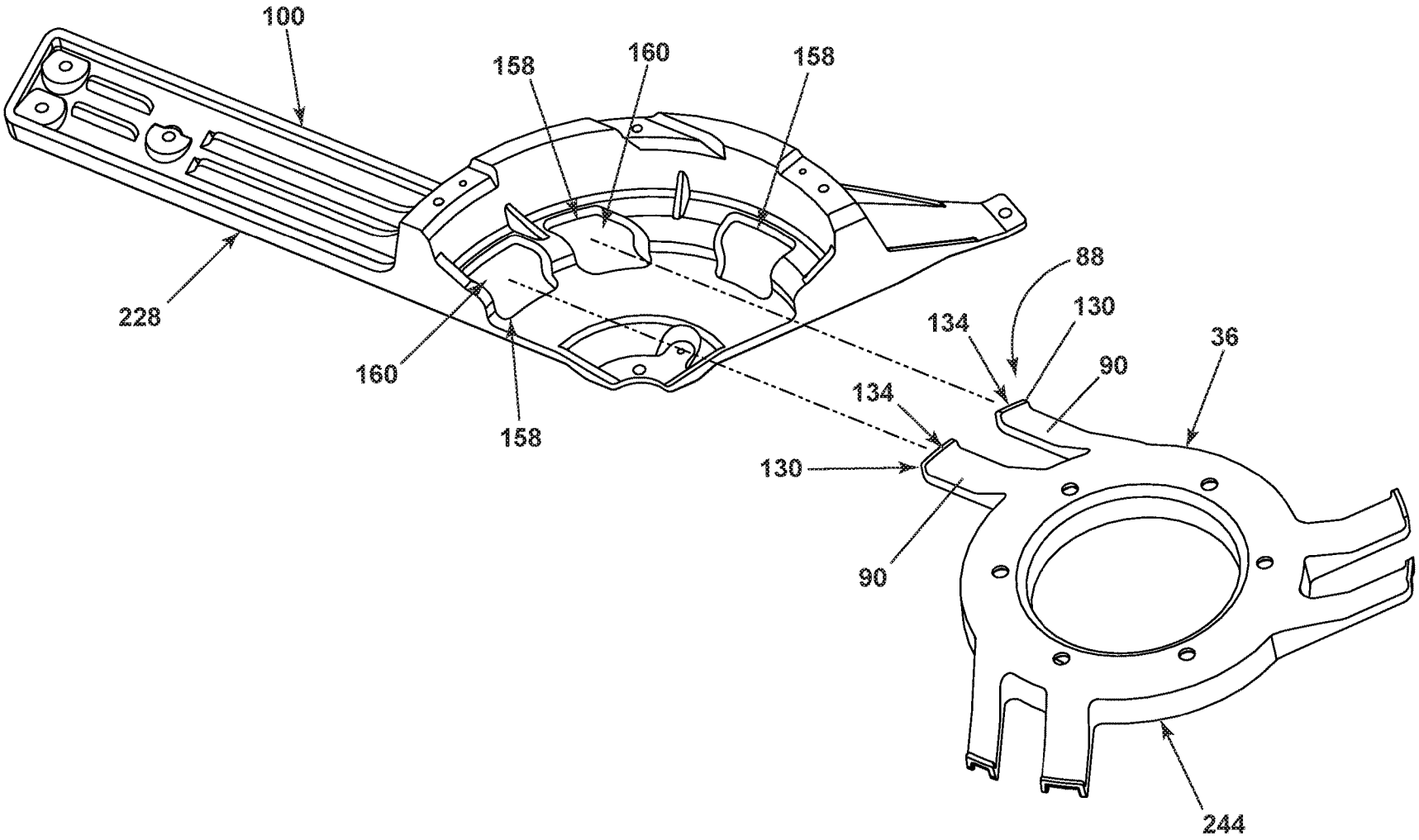
FIG. 7 is an exploded view of the iron hanger and one blade iron of the set of blade irons of FIG. 2, illustrating attachment of the blade iron by inserting arms of the iron hanger through the openings in the blade iron.
Figure 8:
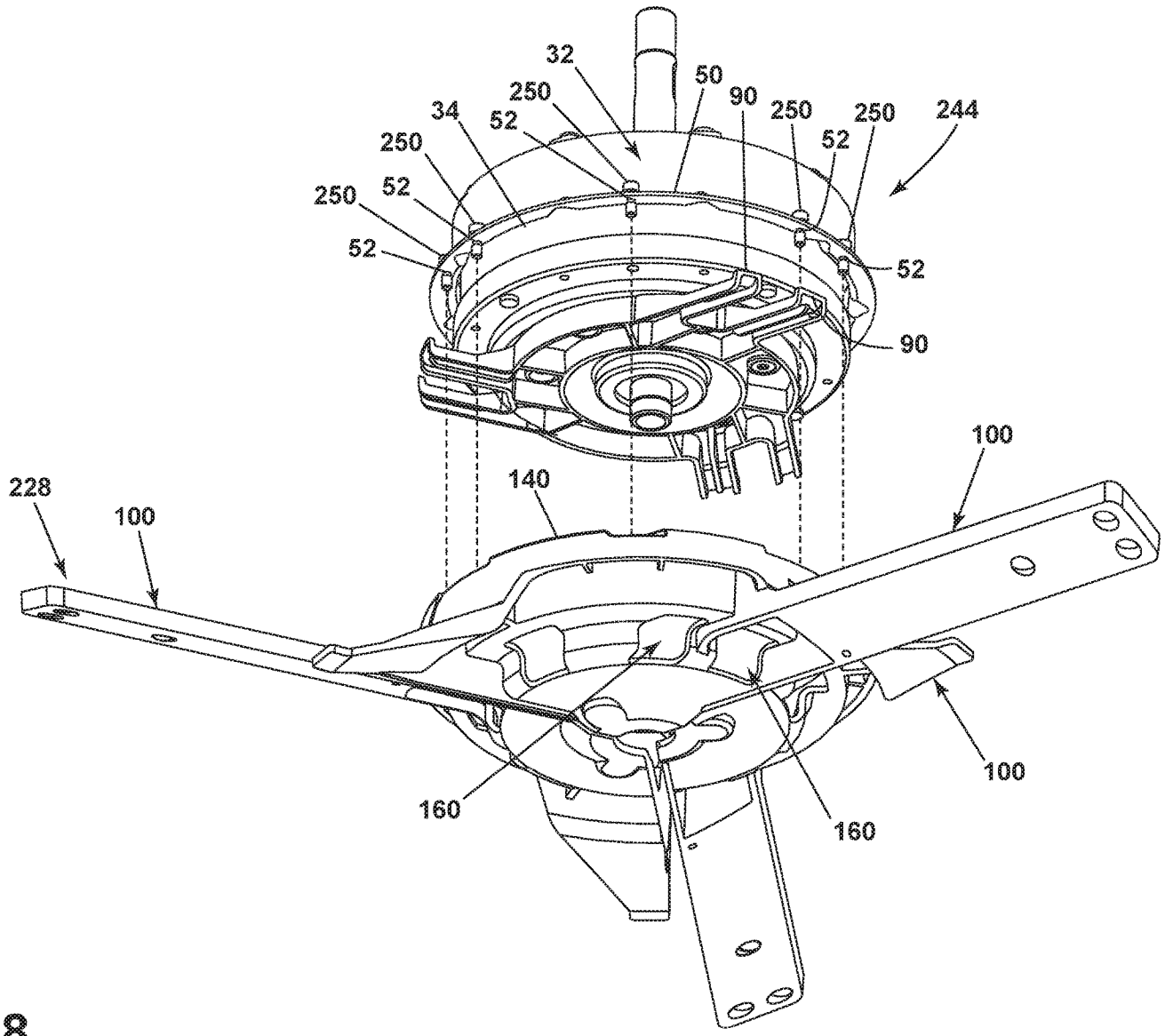
FIG. 8 is an exploded view of the coupled motor assembly, mount ring, and iron hanger of FIG. 2, exploded from the set of blade irons, illustrating further attachment of the blade irons to the motor assembly.

Referring now to FIGS. 7 and 8, the assembly of the blade assembly 228 of FIG. 5 to the motor mount assembly 244 of FIG. 6 will be described. Initially, referring to FIG. 7, the blade iron 100 and the iron hanger 36 will be isolated for clarity, as the remaining elements of the blade assembly 228 and the motor mount assembly 244 may obscure the view, however, it should be understood that such assembly as discussed in FIG. 7 will be utilizing the completed blade assembly 228 of FIG. 5 and motor mount assembly 244 of FIG. 6. Similarly, in regards to FIG. 8, the blades 110 have been removed from the blade irons 100 for clarity to prevent obscuring of the blade irons 100. However, it should be understood that blade assembly 228 includes the blades 110 attached to the blade irons 100.

Referring now to FIG. 7 specifically, the blade assembly 228 can initially connect to the motor mount assembly 244 by inserting a set of arms 88 into the set of openings 158 in the blade iron 100. Specifically, the two arms 90 can align and insert into the two adjacent arm openings 160. Upon insertion, the hooks 134 formed at the tips 130 of the arms 90 can engage the blade iron 100 through the arm openings 160, initially hanging the blade iron 100 and attached blade assembly 228 from the iron hanger 36, and therefore, the motor mount assembly 244. This initial hooked assembly provides for holding and supporting the blade assembly with the iron hanger 36 at the blade iron 100, which facilitates final attachment and securing of the blade assembly 228 to the motor mount assembly. In this way, the installer need not hold and support the blade assembly 228 during attachment to the motor mount assembly 244, therefore facilitating assembly of the ceiling fan 10.

Referring now to FIG. 8, after inserting the two arms 90 into the arm openings 160 of each blade iron 100, the blade irons 100 can be secured to the remainder of the motor mount assembly 244. The blade irons 100 are shown exploded from the arms 90 to clarify how the blade irons 100 mount to the motor assembly 34, while it should be understood that fastening of the blade iron 100 to the motor assembly 34 can occur with the arms 90 inserted through the arm openings 160 in the blade irons 100.

A set of fasteners 250, such as thumb screws for example, extending through the second set of fastener apertures 52 in the iron mount wall 50 of the mount ring 32 can insert into the unoccupied set of apertures 148 in the top wall 140 of the blade iron 100. In this way, the blade iron 100 is secured to the motor mount assembly 244 via the mount ring 32 coupled to the motor assembly 34. In this way, the three blade assemblies 228 can hang onto the arms 90 of the iron hanger 36, and facilitate securing to the mount ring 32. After installing the blade assemblies 228 to the motor mount assembly 244, the motor housing 20 (FIG. 1) can be positioned over and secured to the motor mount assembly 244, hiding the upper portion of the motor mount assembly 244. In this way, the ceiling fan 10 provides for facilitating installation, which provides for no visible hardware after completion.

The ceiling fan 10 as described herein provides for an improved mount assembly for mounting blades to a motor. The assembly facilitates installation and provides for a ceiling fan with no visible hardware. Additionally, the blade irons can provide for improved mounting, which can reduce blade sag and improve overall operational efficiency.

Referring now to FIGS. 9-12, an alternative ceiling fan 310 can be substantially similar to that of FIGS. 1-8. As such, similar numerals will be used to describe similar elements, increased by a value of three-hundred, and the discussion will be limited to differences between the two.

Figure 9:
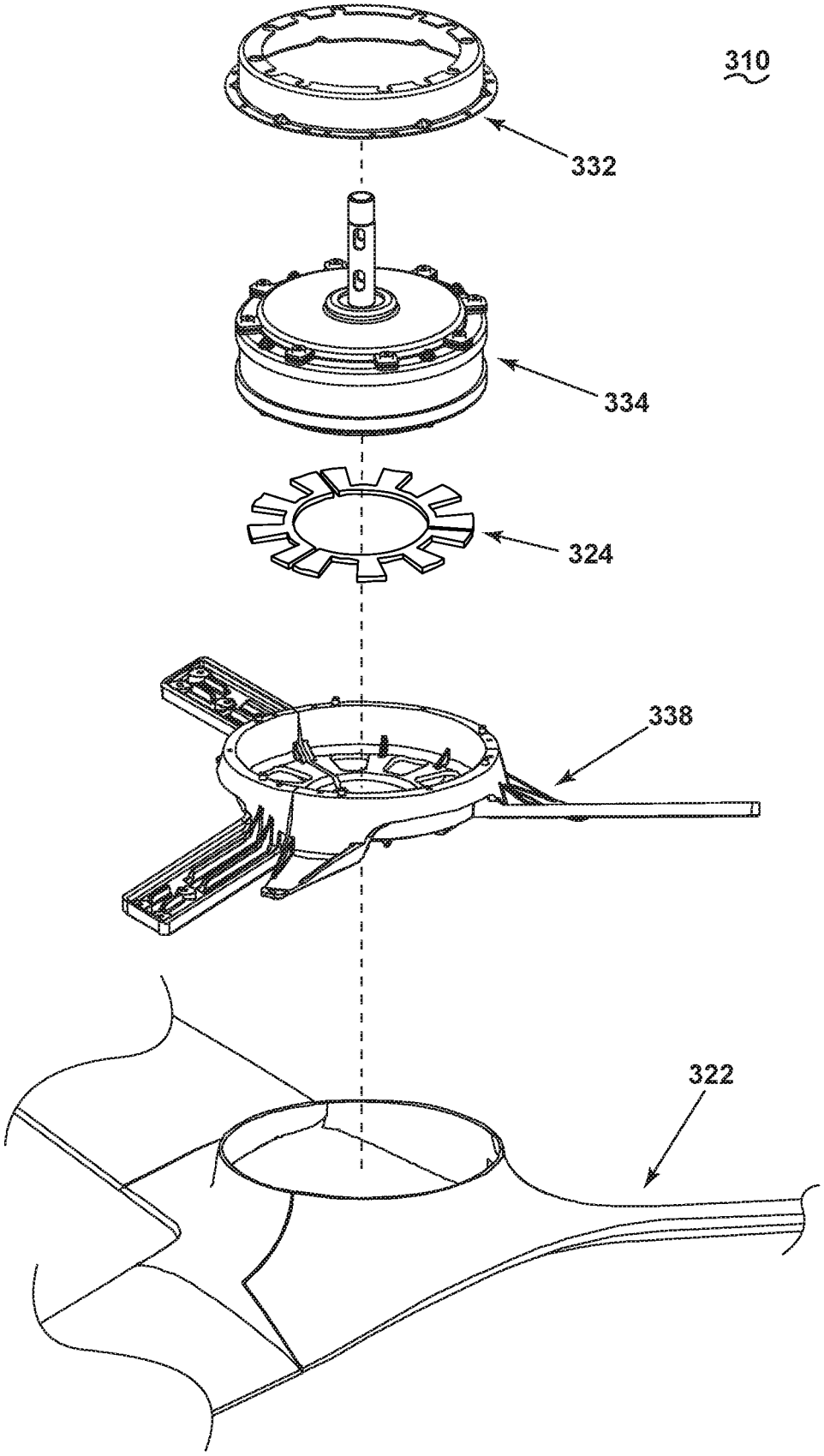
FIG. 9 is an exploded view of an alternative ceiling fan.

Referring now to FIG. 9, the ceiling fan 310 includes a mount ring 332, a motor assembly 334, a spacer 324, a set of blade irons 338, and a set of blades 322, while the ceiling fan 310 can include additional elements, such as those described in FIG. 1. The spacer 324 can couple to the motor assembly 334, or can be secured to the motor assembly 334 by the blade irons 338.

Figure 10:
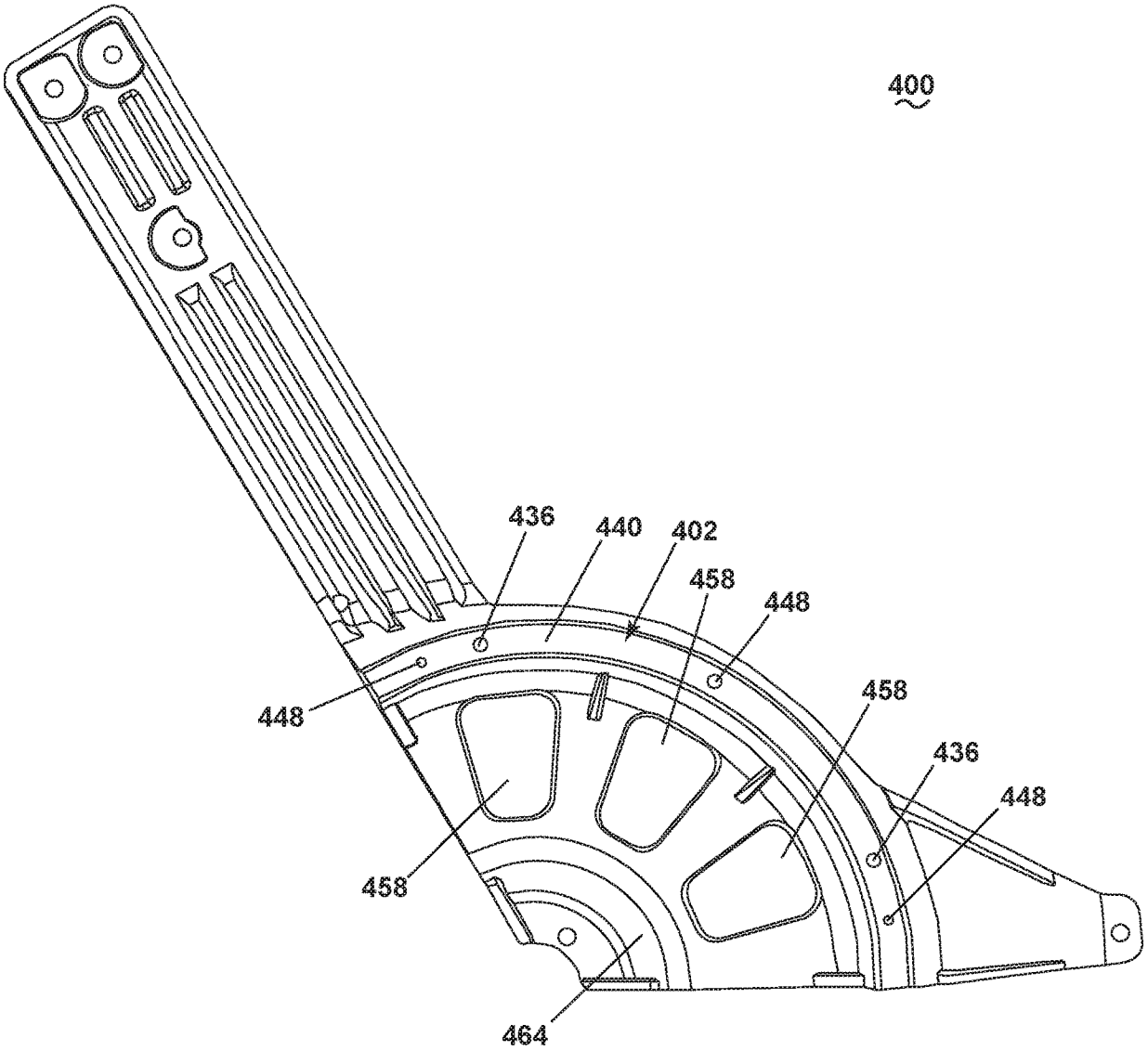
FIG. 10 is a top view of a blade iron of the ceiling fan of FIG. 9.

Referring now to FIG. 10, one blade iron 400 of the set of blade irons 338 can include three openings 458, which are similar to one another and equally spaced. The top wall 440 of the body 402 need not includes the grooves 146, such as those shown in FIG. 4. The top wall 440 can include a set of protrusions 436, such as pegs, spaced between the set of apertures 448. The bottom wall 464 need not include the depression 166, such as that of FIG. 4.

Figure 11:
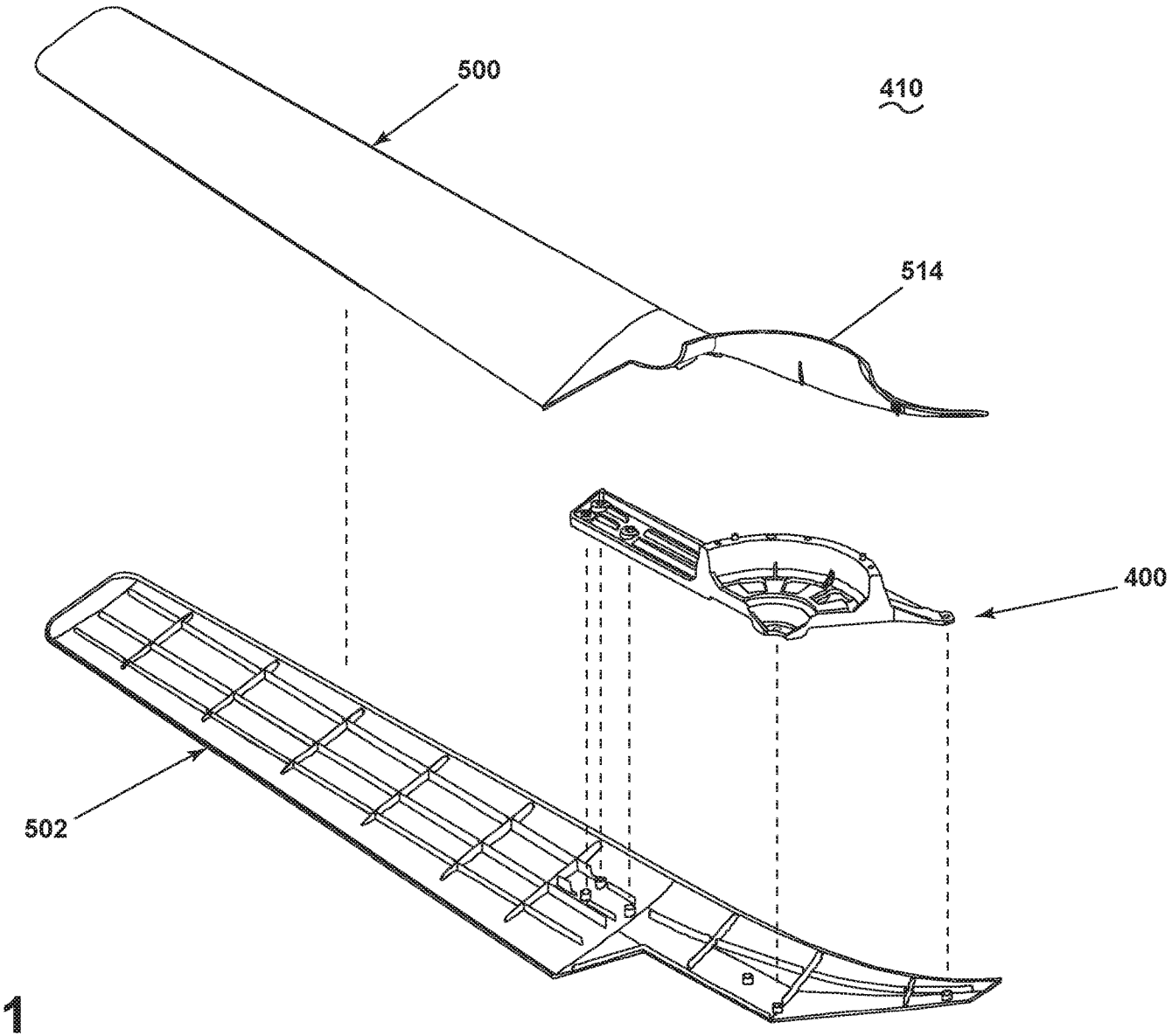
FIG. 11 is an exploded view of a blade of the ceiling fan of FIG. 9, exploded from the blade iron of FIG. 10.

Referring now to FIG. 11, the upper portion 500 of the blade 410 need not include the set of fastener extensions 216 in the interior edge 514, such as that of FIG. 5, and can merely fasten to the lower portion 502 alone, without coupling to any other portion of the ceiling fan 310.

Figure 12:
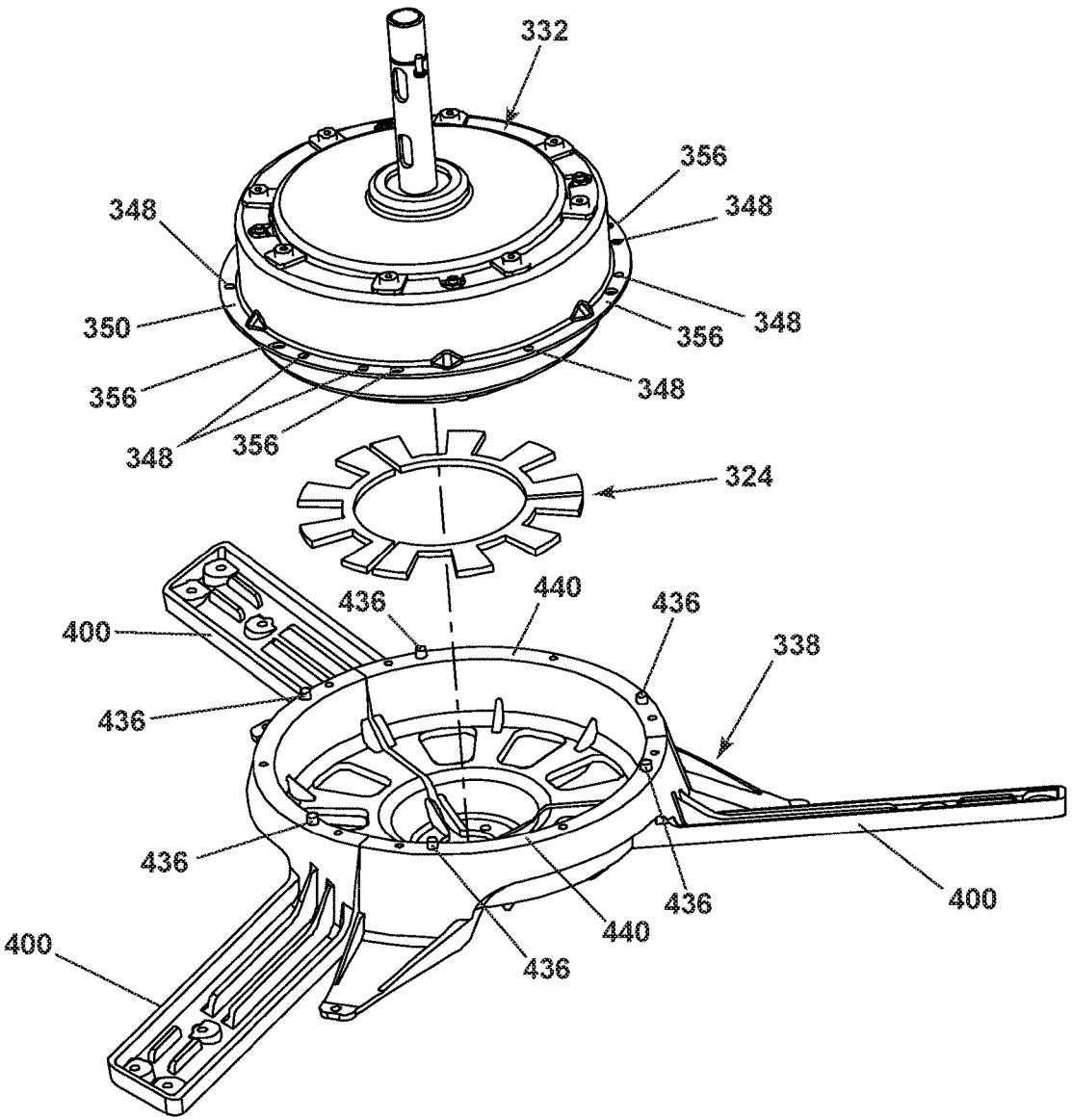
FIG. 12 is an exploded view of a motor assembly exploded from a set of blade irons of FIG. 10, including a spacer.

Referring now to FIG. 12, in assembling the ceiling fan 310, the spacer 324 can be three-part, and can couple to the motor assembly 334, and can secure in place by the set of blade irons 338. The spacer 324 can secure, for example, with an adhesive, or other suitable means, such as a fastener like a screw, in non-limiting examples. The mount ring 332 can include a third set of fastener apertures 356, spaced among the first set of fastener apertures 348 in the iron mount wall 350. The third set of fastener apertures 356 can be spaced and arranged complementary to the set of protrusions 436 extending from the top wall 440 of the blade iron 400.

In assembly, the spacer 324 can couple to or position at the bottom of the motor assembly 334, and the blade irons 338 can secure to the mount ring 332. The protrusions 436 of the blade iron 338 can insert into the third set of fastener apertures 356 on the mount ring 332, aligning the blade irons with the mount ring 332. Fasteners, such as screws or bolts, can be inserted through the first set of fastener apertures 348 in the iron mount wall 350 of the mount ring 332 and insert into the set of apertures 448 on the top wall 440 of the blade iron 400, securing the blade irons 400 to the motor assembly 334 via the mount ring 332.

The ceiling fans as described herein provide for facilitating installation, and provide for a ceiling fan without any exposed hardware. Additionally, the blade irons provide for reduced blade sag, which can provide for improved ceiling fan lifetime and efficiency. This can further prevent for a quieter operation and an improved overall consumer experience.

To the extent not already described, the different features and structures of the various embodiments of the present disclosure may be used in combination with each other as desired. For example, one or more of the features illustrated and/or described with respect to one FIGS. 1-8 can be used with or combined with one or more features illustrated and/or described with respect to FIGS. 9-12. That one feature may not be illustrated in all of the embodiments is not meant to be construed that it cannot be, but is done for brevity of description. Thus, the various features of the different embodiments may be mixed and matched as desired to form new embodiments, whether or not the new embodiments are expressly described.

While aspects of the present disclosure have been specifically described in connection with certain specific embodiments thereof, it is to be understood that this is by way of illustration and not of limitation. Reasonable variation and modification are possible within the scope of the forgoing disclosure and drawings without departing from the spirit of the present disclosure which is defined in the appended claims.

What is claimed is:

1. A ceiling fan comprising:

a motor having a rotor rotatable about a rotational axis;

at least one blade iron mounted to the rotor and having a first blade mount located radially exteriorly of the rotor and a second blade mount located radially interiorly of the rotor; and a blade mounted to both the first and second blade mount and having a tip extending radially beyond the second blade mount.

2. The ceiling fan of claim 1 wherein the at least one blade iron comprises multiple blade irons.

3. The ceiling fan of claim 2 wherein the multiple blade irons are radially spaced about the rotational axis.

4. The ceiling fan of claim 2 wherein the multiple blade irons collectively form a structure underlying the motor.

5. The ceiling fan of claim 1 wherein the rotor is an external rotor.

6. The ceiling fan of claim 5 wherein the motor comprises a stator and the external rotor circumscribes the stator.

7. The ceiling fan of claim 6 further comprising a ceiling mount coupled to the stator.

8. The ceiling fan of claim 1 wherein the rotor comprises a peripheral ring and the blade iron mounts to the peripheral ring.

9. The ceiling fan of claim 8 wherein the blade iron comprises an arcuate portion confronting the peripheral ring.

10. The ceiling fan of claim 9 further comprising a third blade mount spaced from the first blade mount and extending from the arcuate portion radially exterior of the rotor periphery.

11. The ceiling fan of claim 1 wherein the blade comprises a root mounted to a third blade mount.

12. The ceiling fan of claim 11 wherein the blade is two-part, including an upper portion and a lower portion, with the lower portion mounted to the at least one blade iron.

13. A ceiling fan comprising:

a motor assembly including a stator and a rotor defining a rotor periphery and rotatable about the stator;

a blade iron coupled to the rotor and including an arcuate body having a first end and a second end, with a first blade mount provided at the first end and a second blade mount spaced from the first blade mount and provided at the second end, with the first blade mount and the second blade mount extending radially exterior of the rotor periphery; and a blade mounted to the blade iron at both the first blade mount and the second blade mount.

14. The ceiling fan of claim 13 wherein the first blade mount is located radially exterior of the rotor and the second blade mount is located radially interior of the rotor periphery.

15. The ceiling fan of claim 13 further comprising a blade iron hanger coupled to the rotor and having an annular body with a set of arms configured to hang the blade iron from the rotor.

16. The ceiling fan of claim 15 wherein the blade iron includes a set of apertures complementary to the set of arms of the blade iron hanger.

17. The ceiling fan of claim 16 wherein the set of arms of the blade iron hanger inserts through the set of apertures in the blade iron to hang the blade iron from the rotor.

18. The ceiling fan of claim 16 wherein each arm of the set of arms includes a hook at an end of each arm.

19. The ceiling fan of claim 16 wherein the blade is two-part, including an upper portion and a lower portion.

20. A ceiling fan comprising:

a motor assembly including a stator and a rotor rotatable about the stator;

a blade iron hanger coupled to the rotor including an annular body and at least one arm extending from the annular body; and a blade iron including at least one opening adapted to receive the at least one arm of the blade iron hanger through the at least one opening to hang the blade iron from the blade iron hanger to facilitate alignment and mounting of the blade iron to the rotor.

21. The ceiling fan of claim 20 further comprising a hook provided on the at least one arm spaced from the annular body.

22. The ceiling fan of claim 20 wherein the at least one arm includes a pair of two arms.

23. The ceiling fan of claim 22 wherein the at least one opening includes a pair of openings complementary to the pair of two arms.

* * * * *